US007866106B2

(12) United States Patent
Bowlware

(10) Patent No.: US 7,866,106 B2
(45) Date of Patent: Jan. 11, 2011

(54) PORTABLE BALLISTICS BARRIER

(76) Inventor: Daniel S. Bowlware, 2006 Bonnycastle La., Yukon, OK (US) 73099

( * ) Notice: Subject to any disclaimer, the term of this patent is extended or adjusted under 35 U.S.C. 154(b) by 144 days.

(21) Appl. No.: 12/036,924

(22) Filed: Feb. 25, 2008

(65) Prior Publication Data

US 2009/0020241 A1 Jan. 22, 2009

Related U.S. Application Data

(60) Provisional application No. 60/961,301, filed on Jul. 20, 2007.

(51) Int. Cl.
*E04B 2/00* (2006.01)

(52) U.S. Cl. ..... 52/424; 52/425; 52/426; 52/592.1; 52/574; 404/6; 89/36.02; 89/36.07

(58) Field of Classification Search ..... 52/424–426, 52/592.1, 569–572, 574; 404/6; 89/36.02, 89/36.07

See application file for complete search history.

(56) References Cited

U.S. PATENT DOCUMENTS 3,818,658 A * 6/1974 Slaven ..... 52/169.1
4,433,522 A * 2/1984 Yerushalmi ..... 52/426
5,228,257 A * 7/1993 Bowersox et al. ..... 52/588.1
5,452,963 A * 9/1995 Christensen ..... 404/6
6,059,491 A * 5/2000 Striefel et al. ..... 405/111
6,086,285 A * 7/2000 Christensen ..... 404/6
6,212,845 B1 * 4/2001 De Zen ..... 52/607
6,533,495 B1 * 3/2003 Williams et al. ..... 404/6
6,863,468 B2 * 3/2005 Davis et al. ..... 404/6
6,932,537 B2 * 8/2005 Witcher ..... 404/6
7,383,761 B2 * 6/2008 Warren ..... 89/36.02
7,415,806 B2 * 8/2008 Davidson ..... 52/426
7,437,987 B1 * 10/2008 Ohnstad et al. ..... 89/36.04
7,575,797 B2 * 8/2009 Karr et al. ..... 428/137

FOREIGN PATENT DOCUMENTS

GB 2235942 A * 3/1991

OTHER PUBLICATIONS http://web.archive.org/web/20061029165343/http://www.theboxotruth.com/docs/bot31.htm.*

* cited by examiner

*Primary Examiner*—Richard E Chilcot, Jr.
*Assistant Examiner*—Mark R Wendell
(74) *Attorney, Agent, or Firm*—Dunlap Codding, P.C.

(57) ABSTRACT

A barrier comprising a body member. The body member has a first side, a second side, a front side, a rear side, and one or more cavities within the body member. The body member further has a first overlap portion and a second overlap portion. The first overlap portion extends from the first side adjacent to the front side and spaced apart from the rear side. The second overlap portion extends from the second side adjacent to the rear side and spaced apart from the second side. The second overlap portion is shaped to mate in an overlapping manner with the first overlap portion of an adjacent body member. A barrier wall comprising two or more barriers is also disclosed.

25 Claims, 10 Drawing Sheets

PORTABLE BALLISTICS BARRIER

CROSS-REFERENCE TO RELATED APPLICATIONS

This application claims benefit of U.S. Provisional Application No. 60/961,301, filed Jul. 20, 2007, which is incorporated herein by reference in its entirety.

BACKGROUND OF THE INVENTION

1. Field of the Invention

The present invention generally relates to barriers. More specifically, but not by way of limitation, the present invention relates to portable ballistic barriers.

2. Brief Description of Related Art

There are a number of situations and locations in which barriers are useful for a variety of purposes. For example, barriers may be used to route traffic, protect structures, and the like. In many instances, it is highly desirable for such barriers to be portable so they may be easily transported to a point-of-use and installed with a minimum of effort, manpower, footing structures, and/or equipment. However, it is also highly desirable that such barriers be durable and strong enough to protect from potential dangers. Potential dangers may include people crossing the barriers, cars crashing into the barriers, and/or bullets, shrapnel, blasts, and the like that could puncture and/or destroy the barriers and cause damage or injury to structures, objects, and/or individuals protected by the barriers.

Often, the weight and difficulty of installation of a barrier increase as the durability and strength of the barrier increase. For example, concrete blast barriers may require cast in place footings, heavy equipment to transport and install, or may not be transportable at all. Conversely, plastic traffic barriers may be made of plastic so as to be relatively easy to transport and install, but may be limited in the amount of protection they provide from various potential dangers.

Some plastic barriers, such as traffic barriers, may be placed at a point-of-use and subsequently filled with water or other liquid material. Such liquid adds weight to the barrier and generally increases the amount of energy the barrier can absorb. For example, the added weight of the liquid may absorb enough energy to slow or partially deflect a vehicle that impacts the barrier. However, the liquid within such a barrier may be insufficient for smaller projectiles such as bullets and/or shrapnel, which impart their energy on a much-smaller area of the barrier. In addition, once the barrier is penetrated, fluids drain at the point of penetration, thereby leaving the barrier non-effective. As such, there are numerous instances where stronger and more-durable barriers are desirable.

For example, one instance where stronger and more durable barriers are desirable is for the protection of electrical, gas, and/or water treatment stations or substations, especially in rural areas, which may contain equipment that is particularly susceptible to projectiles, bullets, shrapnel, blasts, and the like. Additionally, such stations and substations may house equipment whose damage and/or failure may have far-reaching consequences, such as, for example, power outages, environmental contamination and the like. In many instances, the equipment is non-replaceable due to the age of the equipment used or the fact that the equipment is not produced anymore. As such, stations and substations of this type may be more likely to be targeted by terrorists and the like.

A number of barriers and barrier panels have been suggested to protect structures, facilities, and the like from bullets and other projectiles. Many of such known barriers are complex, expensive to manufacture, and/or difficult to transport and/or install. For example, some such barriers are of such weight and/or size that they require heavy equipment such as cranes to install. In areas with overhead or underground power lines or grids, soft or sandy soils, and/or other impediments to heavy equipment access, it is difficult, if not impossible, to install such barriers. In addition, footings are required which can affect underground power grids that lie shallow below the ground.

As such, a need exists for stronger and more durable barriers, preferably suited for protection from bullets, blast, and other projectiles, which are portable enough to be installed without the use of heavy equipment or permanent infrastructure.

DETAILED DESCRIPTION OF EXEMPLARY EMBODIMENTS

Figure 1:
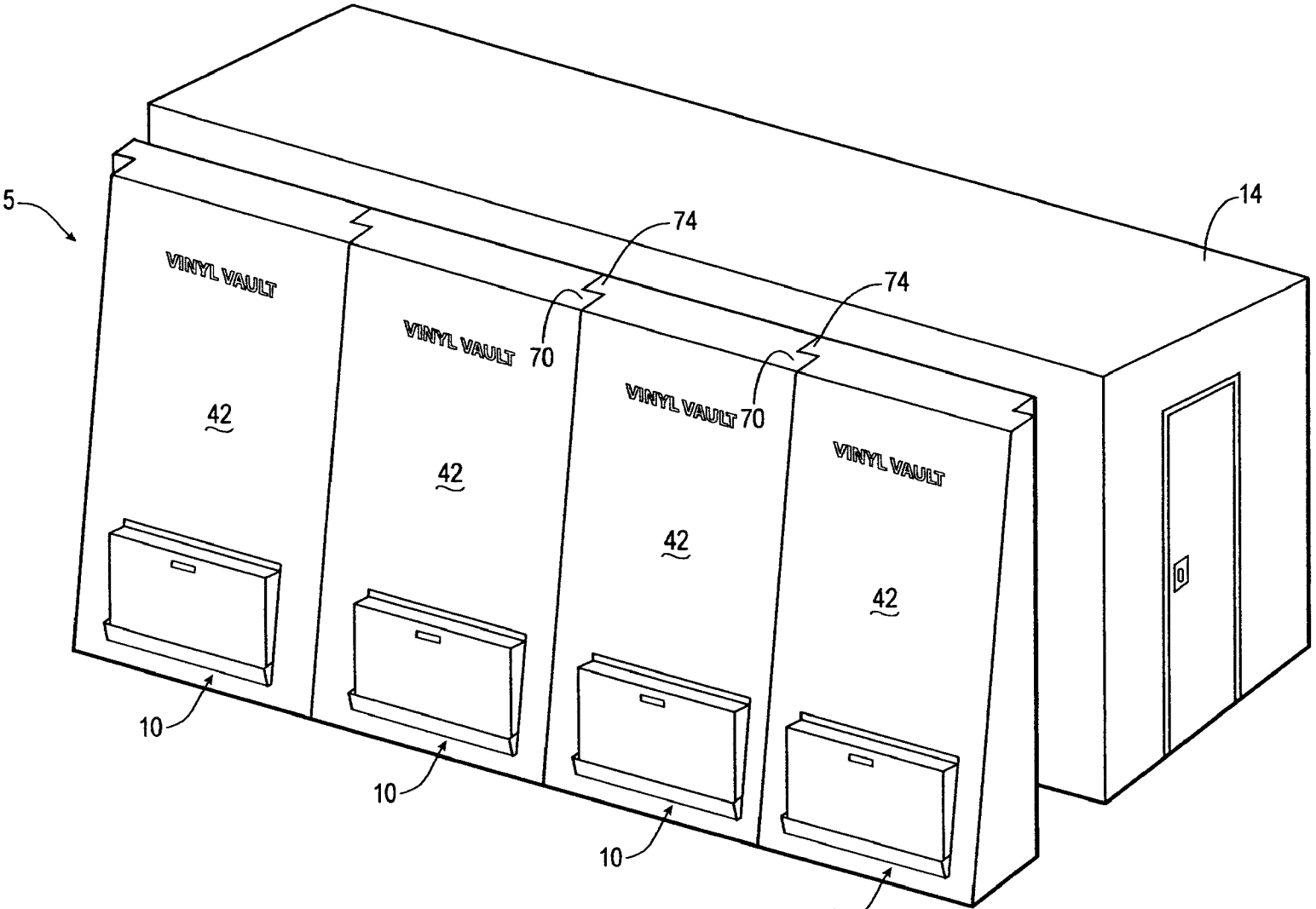
FIG. 1 is a perspective view of a plurality of barriers protecting an exemplary structure and constructed in accordance with the present invention.

Referring now to the drawings, and more particularly to FIG. 1, shown therein and designated by the reference numeral 5 is a barrier wall assembled from and/or including a plurality of barriers 10 constructed in accordance with the present invention. The barriers 10 of the barrier wall 5, are shown protecting an exemplary structure 14. The structure 14 is merely representative of an item which may be protected by the barriers 10. Alternatively, the barriers 10 may be used to protect nearly anything that may be sensitive to or subject to damage by projectiles, vehicles, blasts, and the like, such as, for example, open places where people may congregate, parking areas for vehicles, and/or the like. As will be described in more detail below, the barriers 10 are preferably constructed so as to be transportable without the use of heavy machinery, require no footings or permanent infrastructure, e.g., by one or more humans, and also strong and durable enough to substantially protect a structure 14 from potential dangers, such as bullets, blast, shrapnel, and the like.

The barriers 10 preferably completely prevent projectiles and the like from passing therethrough so as to prevent such projectiles from impacting or contacting the structure 14. However, it may not be possible to stop all projectiles, depending on a number of factors, such as the size, shape, mass, velocity, and other characteristics of the projectile, as well as the number and characteristics of projectiles and the like that have previously impacted the barriers 10. However, the barriers 10 preferably at least absorb some portion, if not all, of the energy of a projectile impacting the barriers 10, so as to minimize or at least reduce the damage caused to the structure 14 by the projectile.

Although the barrier wall 5 is shown having four identical barriers 10, it should be understood that, in other embodiments, the barrier wall 5 may include any suitable number of barriers 10, such as for example, one barrier, two barriers, three barriers, eleven barriers, or the like. Similarly, the barrier wall 5 may include different or non-identical barriers 10. For example, a barrier wall 5 may include end barriers (not shown) that are only adapted to interact or cooperate with an adjacent barrier 10 on a single side, pivot or angle barriers (not shown) for constructing an adjustable or fixed angle between barriers 10, or any other suitable other types of barriers (not shown) that may be used in conjunction with, or in place of, the barriers 10.

Figure 2:
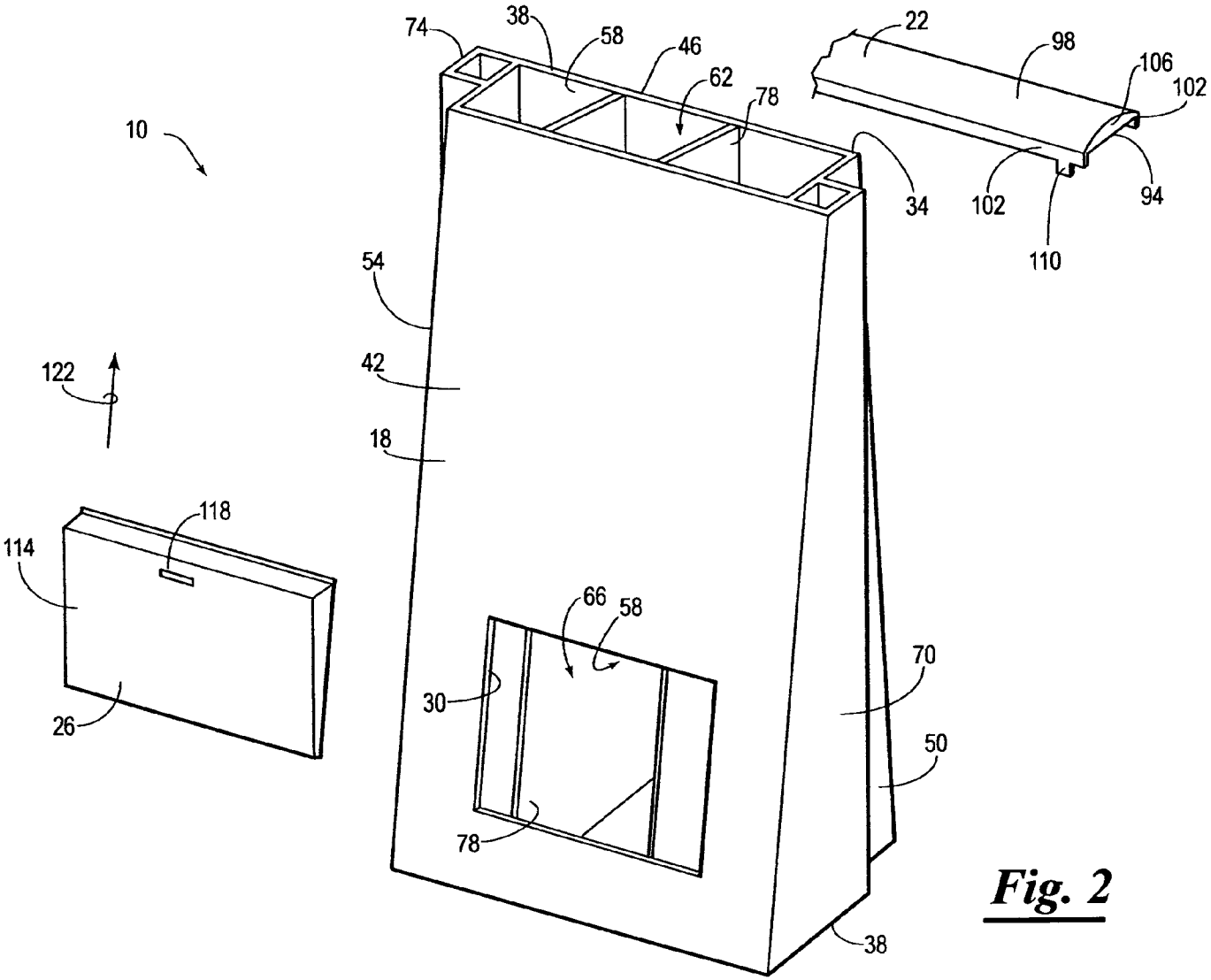
FIG. 2 is a partially-exploded perspective view of one embodiment of a barrier constructed in accordance with the present invention.
Figure 3:
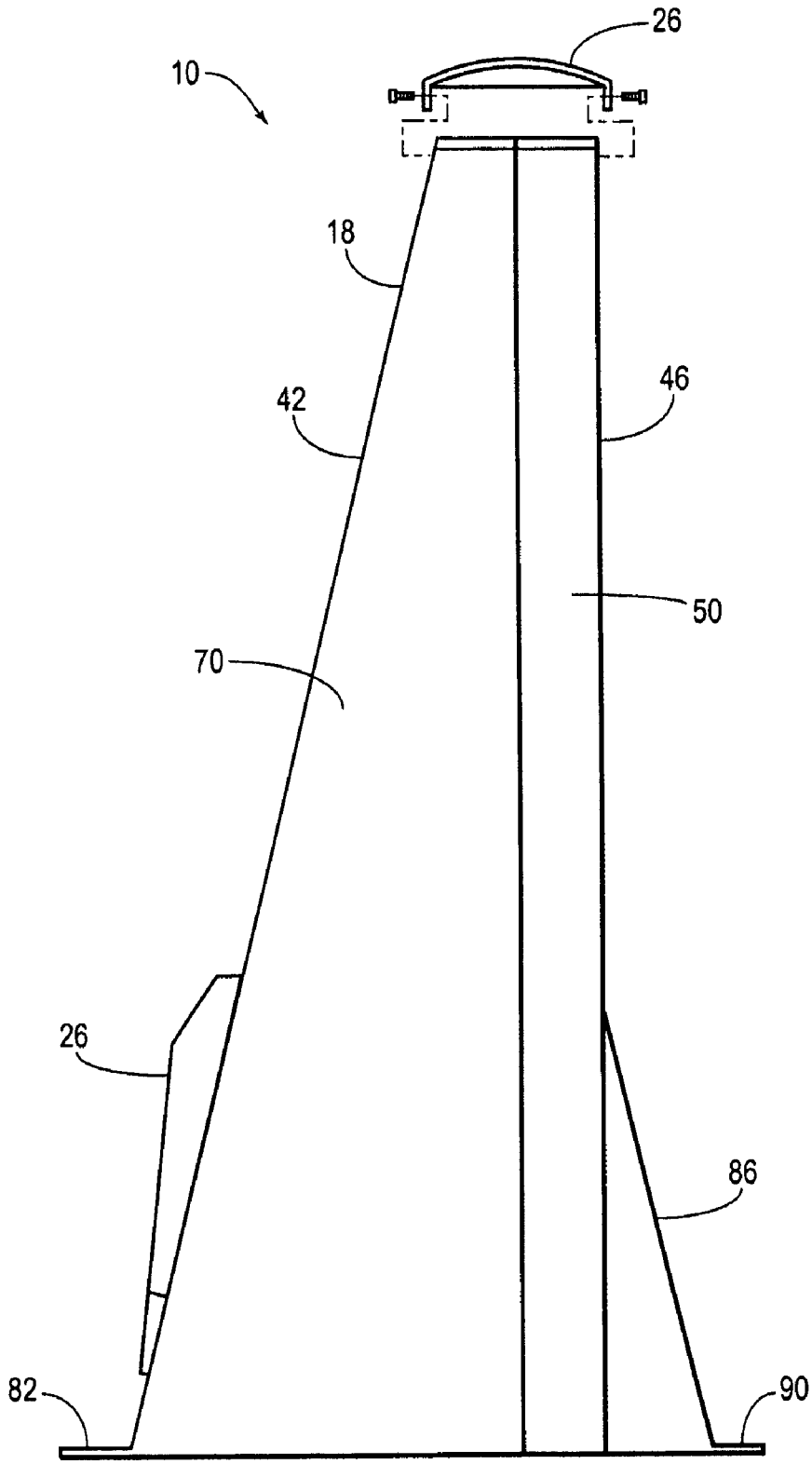
FIG. 3 is a partially-exploded side view of the barrier of FIG. 2.

Referring now to FIGS. 2 and 3, an enlarged perspective view of a barrier 10 of FIG. 1 is shown constructed in accordance with the present invention. The barrier 10 preferably includes a body portion 18, an upper cover 22, and a side cover 26. The body portion 18 preferably has one or more sidewalls 30 defining an upper end 34, a lower end 38, a front side 42, a rear side 46, a first side 50, and a second side 54. As best seen in FIG. 3, one preferred embodiment of the body portion 18 is provided with a wedge shape, or what may be considered an inverted-wedge shape wherein the lower end 38 is larger than the upper end 34 and the body portion 18 is preferably tapered therebetween.

The one or more sidewalls 30 also preferably define one or more cavities 58 within the body portion 18. Unless otherwise state herein, the barrier 10 and various parts thereof are preferably formed of a relatively light-weight, durable, and at least semi-rigid material, such as, for example, vinyl, aluminum, polymer, plastic, fiberglass, alloy, sheet metal, or the like. Additionally, the sidewall 30 and/or various other interior walls, dividers, parts, portions, and the like may be contiguously formed as a single piece, as a plurality of pieces each having one or more walls or portions, or may be individually formed and thereafter connected or fastened together. As such, the barrier 10 and its various components may be formed, connected, fastened, and the like by any suitable means, such as, for example, molding, adhesives, machining, heat or chemical welding, stamping, punching, and the like.

The lower end 38 is preferably larger than the upper end 34 so as to provide stability such that the barrier 10 resists tipping, as may be encourage by lateral forces imparted by the impact of a projectile or vehicle impacting the barrier 10. The lower end 38 is preferably closed, covered, or enclosed so as to retain a fill material (not shown) within the one or more cavities 58, as will be described in more detail below. To this end, the upper end 34 is preferably provided with one or more upper openings 62 in communication with the one or more cavities 58 so as to permit the one or more cavities 58 to be filled with the fill material (not shown). The body portion is also preferably provided with one or more lower openings 66 formed through the front side 42 of the sidewall and in fluid communication with the one or more cavities 58 to permit removal of the fill material (not shown) from the one or more cavities 58. Although the one or more upper openings 62 are described for insertion of a fill material (not shown) into the one or more cavities 58 and the one or more lower openings 66 are described for removal of a fill material (not shown) from the one or more cavities 58, it should be appreciated that either of the upper and lower openings 62 and 66 may be used for either or both purposes, e.g., the upper opening 62 may be used for removing a fill material or emptying the one or more cavities 58 and the lower opening may be used for filling the one or more cavities 58.

The one or more sidewalls 30 of the body portion 18 also preferably define a first lateral extension portion 70 extending from the first side 50, and a second lateral extension portion 74 extending from the second side 54. The first and second lateral extension portions 70 and 74 may also be referred to herein as first and second overlap portions 70 and 74. As shown, the first lateral extension portion 70 is preferably adjacent to the front side 42 of the body portion 18, and spaced apart from the rear side 46 of the body portion 18. In opposite fashion, the second lateral extension portion 74 is preferably adjacent to the rear side 46 and spaced apart from the front side 42. Additionally, the one or more cavities 58 defined within the body portion 18 preferably extend into, or are separately defined within, the first and second lateral extension portions 70 and 74. In this way, the one or more cavities 58 or portions thereof defined within the first and second lateral extension portions 70 and 74 may be filled with and/or emptied of a fill material (not shown) in like manner as is described above, and as will be described below in more detail.

When, as shown in FIG. 1, any two barriers 10 are placed adjacent to one another with their front sides 42 facing the same direction, the first lateral extension portion 70 of one of the two barriers 10 overlaps and is overlapped by the second lateral extension portion 74 of the other of the two barriers 10. The first and second lateral extension portions 70 and 74 of first and second adjacent barriers 10, respectively, preferably cooperate and/or engage and/or interlock one another to ensure that no gap is left between adjacent barriers 10 that could provide a vulnerable or "soft" spot where a projectile could penetrate without substantial resistance.

Additionally, the first and second lateral extension portions 70 and 74 are preferably shaped to minimize or prevent any gaps therebetween, such that the combination of the first lateral extension portion 70 of a barrier 10 cooperates with the second lateral extension portion 74 of an adjacent barrier 10 to provide full-depth protection between the front side 42 of the first lateral extension portion 70 of the first barrier 10 and the rear side 46 of the second lateral extension portion 74 of the second barrier 10. As such, the barrier 10 of the present invention preferably cooperates with adjacent barriers 10 to provide full-depth protection at all points along a barrier wall 5 without any full-depth gaps or unprotected seams between adjacent barriers 10. The barrier 10 may be constructed so as to interlock an adjacent barrier 10 without additional fasteners (not shown), to be held in place by its own weight, or to be fastened to an adjacent barrier 10 by any suitable means, such as, for example, screws, bolts, straps, pins, rods, rivets, adhesive, welds, or the like. Although the function of the first and second lateral extensions 70 and 74 is described above with reference to two barriers 10, it will be appreciated that the construction of the barrier 10 is such that any suitable number of barriers 10 may cooperate as described above to form a barrier wall 5 of the type depicted in FIG. 1.

Multiple barriers 10 are preferably standardized such that the first lateral extension portion 70 of a first barrier 10 is the same as the first lateral extension portion 70 of a second barrier 10. Similarly, the second lateral extension portion 74 of a first barrier 10 is preferably the same as the second lateral extension portion 74 of a second lateral extension portion 74 of a second barrier 10. As discussed above, the first lateral extension portion 70 of a first barrier 10 is sized and shaped to correspond to and complement the size and shape of the second lateral extension portion 74 of a second barrier 10 to function as described and depicted herein. As such, it should be appreciated that the first lateral extension portion 70 of a first barrier 10 is sized and shaped to correspond to and complement the size and shape of the second lateral extension portion 74 of the first barrier 10, and vice versa.

For example, in the embodiment shown in FIGS. 2 and 3, the first and second lateral extension portions 70 and 74 of the barrier 10 cooperate with and/or complement one another to substantially define the laterally-cross-sectional shape depicted in FIG. 3, optionally including or excluding stabilizers and/or stabilizer feet, described below. Similarly, the first lateral extension portion 70 preferably has the same width, taken parallel to either of the front and rear sides 42 and 46, as the second lateral extension portion 74. Similarly, overlapping or cooperating first and second lateral extension portions 70 and 74 of laterally-adjacent barriers 10 preferably cooperate to provide a combined depth at least as great as, equal to, or greater than, the depth of either of the laterally adjacent barriers 10, as depicted in FIG. 1.

As best shown in FIG. 2, the one or more cavities 58 within the body portion 180 may be partitioned or divided by one or more interior walls 78. The interior walls 78 are preferably substantially planar in shape and may extend entirely across the one or more cavities 58 so as to define a plurality of cavities 58 substantially separate from one another. Similarly, the interior walls 78 may extend only partly across the one or more cavities 58 to merely partition the one or more cavities into sections that remain in fluid communication with one another. Although the embodiment shown includes two interior walls 78 forming three cavities 58 laterally adjacent to one another such that the three cavities 58 together span the entire width of the body portion 18; interior walls 78 may be disposed in any suitable configuration within the body portion 18. For example, the body portion 18 may be provided with a single interior wall (not shown) spanning from the first side 50 to the second side 54 of the body portion 18 so as to define front and rear cavities (not shown), each spanning the entire width of the body portion 18.

In operation, the one or more cavities 58 within the barrier 10 are preferably filled one or more fill materials (not shown) such as sand, soil, clay, gravel, aggregate, cement, paper, polymer(s), alloy(s), and/or the like. In some embodiments, the one or more cavities 58 within the barrier 10 may be filled with two or more fill materials (not shown).

As shown in FIG. 2, one embodiment of the body portion 18 is further provided with a front stability foot 82, a rear stabilizer 86, and a rear stability foot 90. The front stability foot 82 is provided with a flattened shape and preferably extends outward from the lower end 38 of the front side 42 so as to provide additional protection against tipping of the barrier 10. The front stability foot 82 preferably spans the entire width of the body portion 18, however, other embodiments of the barrier 10 may be provided with a plurality of discrete front stabilizer feet 82. The rear stabilizer 86 is preferably provided with a triangular shape, as shown, extending outward from the lower end 38 of the rear side 46 of the body portion 18, so as to provide additional support from or resistance to tipping of the body portion 18. The rear stability foot 90 is similar in construction and function to the front stability foot 82. Additionally, the stabilizer 86 and the front and rear stability feet 82 and 90 provide a relatively large base or "footprint" for the barrier 10, thereby reducing, or preferably eliminating, the need for anchoring, a concrete foundation or footing.

The upper cover is preferably sized and shaped to correspond to the upper end 34 of the body portion 18, such that the upper cover 22 may be placed over the opening 62 to prevent water and debris from entering the one or more cavities 58 and to prevent fill material (not shown) from exiting the one or more cavities 58. The upper cover 22 is formed with a first end 94 and a second end (not shown) that is preferably an identical mirror-image of the first end 94. The upper cover 22 is further provided with a cover portion 98, a pair of longitudinal walls 102, and a pair of end walls 106. The cover portion 98 is preferably formed with a concave arcuate shape to prevent water from pooling and/or standing on the upper cover 22. In other embodiments, the cover portion 98 may be formed with any suitable shape, for example, a peaked or otherwise sloped shape, a flat shape, a fanciful shape, or the like.

The longitudinal walls 102 extend downward from the cover portion 98 between the first end 94 and the second end (not shown) to overlap and preferably engage the front and rear sides 42 and 46 of the body portion 18. In the embodiment shown, the longitudinal walls 102 are provided with attachment tabs 110 adjacent the first end 94 and second end (not shown). The attachment tabs 110 are preferably adapted to be selectively fastened to the body portion 18 by any suitable means, such as, for example, screws, bolts, snaps, or the like. In other embodiments, the upper cover 22 may be selectively fastened to the body portion 18 in any suitable configuration, such as with or without attachment tabs 102, and/or by any suitable means, for example, rivets, adhesives, hook and loop fasteners, interlocking tabs, or the like. The end walls 106 are preferably provided adjacent to each of the first end 94 and the second end (not shown) and extend between the longitudinal walls 102 to provide support thereto.

When a first barrier 10 is adjacent to and used in conjunction with an adjacent barrier 10, the upper cover 22 may extend over one of the first and second lateral extension portions 70 and 74 of the first barrier 10 and may further extend over the other of the first and second lateral extension portions 70 and 74 of the adjacent barrier. Similarly, the upper cover 22 may extend over only a portion of one of the first and second lateral extension portions 70 and 74 of the first barrier 10 and may further extend over only a portion of the other of the first and second lateral extension portions 70 and 74 of the adjacent barrier. In yet further embodiments, the upper cover 22 may be shaped to extend over both of the first and second lateral extension portions 70 and 74 of the first barrier 10, but not extend over any portion of the adjacent barrier 10.

The side cover 26 is sized to cover the opening 66 in the sidewall 30 of the body portion 18. In the embodiment shown, the side cover is provided with a front side 114 having a handle 118 defined therein. The front side 114 of the side cover 26 is preferably angled such that when the side cover 26 engages or is adjacent to the front side 42 of the body member, the front side 114 of the side cover 26 is substantially parallel to the rear side 46 of the body portion 18. In other embodiments, the side cover 26 may be provided with any suitable shape and in any suitable configuration. In the preferred embodiment, the side cover 26 slidably engages the body portion 18 such that the side cover 26 may be slid in an upward direction 122 relative to the body portion 18 so as to permit access to at least one of the one or more cavities 58 via the opening 66. In other embodiments, the side cover 26 may engage or be fastened to the body portion 18 by any suitable means, such as, for example, by way of hinges, pins, bolts, screws, and/or the like. The side cover 26 is also preferably provided with a reinforced structure, or constructed from a projectile or blast-resistant material, so as to resist being damaged to an extent that would permit the fill material (not shown) to drain or exit the body portion 18. For example, the side cover 26 may be reinforced with or otherwise constructed from materials such as Kevlar, ceramic, steel, or any other suitably projectile- and/or blast-resistant material.

Figure 4:
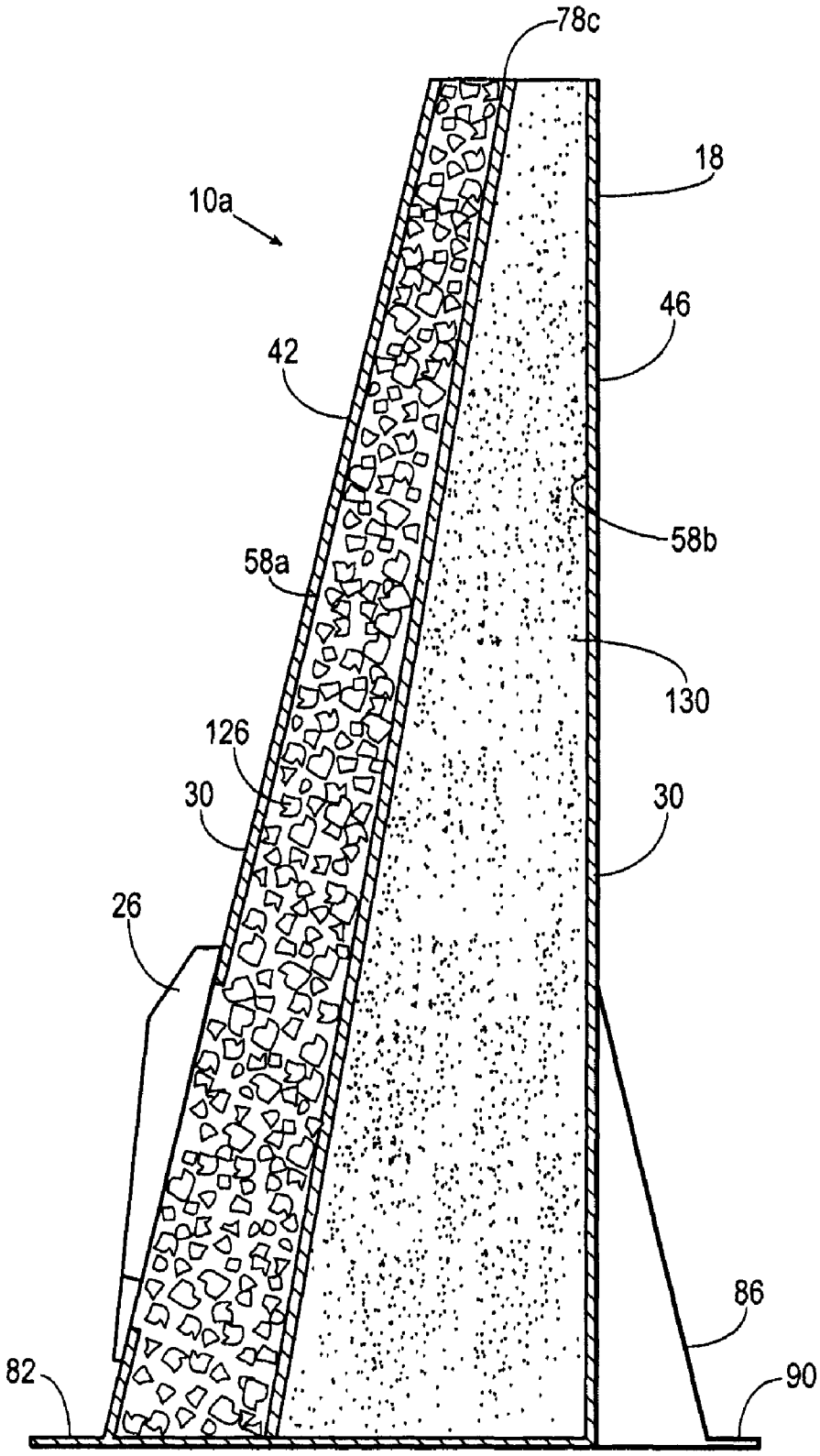
FIG. 4 is a cross-sectional view of a second embodiment of the barrier of FIGS. 2 and 3.

Referring now to FIG. 4, shown therein and designated by the reference numeral 10*a* is a cross-sectional view of a second embodiment of a barrier constructed in accordance with the present invention. The barrier 10*a* is similar in form and function to the barrier 10 of FIGS. 2 and 3, with one primary difference. The barrier 10*a* is provided with an interior wall 78*a* spanning the entire width of the barrier 10*a* so as to define a front cavity 58*a* and a rear cavity 58*b*, each spanning the entire width of the barrier 10*a*. The front cavity 58*a* is filled with a deformation fill material 126 such as aggregate, and the rear cavity 58*b* is filled with an energy-absorption fill material 130 such as sand, clay, soil, or the like. The deformation fill material 126 serves to deform a projectile such as a bullet by causing the projectile to enlarge, fragment, or the like. The energy-absorption fill material 130 absorbs at least a portion of the energy of the deformed projectile and preferably prevents the projectile from passing through the barrier 10*a*. In another embodiment, the one or more cavities 58 within the barrier 10*a* are filled with a mixture of a deformation fill material, such as aggregate, and an energy absorption fill material, such as sand.

In one method of using or deploying the barrier 10, 10*a*, or other embodiments described below, a first barrier 10 is carried or transported by hand by one or more persons to a position where the first barrier 10 is desired for use in protecting a structure, person, object, region, or the like. The side cover 26 of the first barrier 10 is closed and/or secured in a closed position so as to substantially close or seal the side opening 26. The one or more cavities 58 of the first barrier 10*a* are then filled, via the upper opening 62, with a fill material such as a deformation fill material 126, an energy-absorption fill material 130, or any alternative, equivalent, or combination thereof. The upper cover 22 of the second barrier 10 is then carried or transported by hand by one or more persons to a position adjacent to the first barrier 10 such that one of the first and second lateral extension portions 70 and 74 of the second barrier 10 overlaps, and preferably engages, the other of the first and second lateral extension portions 70 and 74 of the first barrier 10. The side cover 26 of the second barrier 10 is closed and/or secured in a closed position so as to substantially close or seal the side opening 26. The one or more cavities 58 of the second barrier 10*a* are then filled, via the upper opening 62, with a fill material, such as a deformation fill material 126, an energy-absorption fill material 130, or any alternative, equivalent, or combination thereof. Such steps performed in any suitable order and repeated in any suitable order for any desired number of barriers 10. Additionally, to move or remove the barriers 10, the steps may be repeated, reversed, and or combined as necessary, and/or combined with the step of opening the side cover 26 and removing the fill material(s) from the one or more cavities 58 via the side opening 66.

Figure 5:
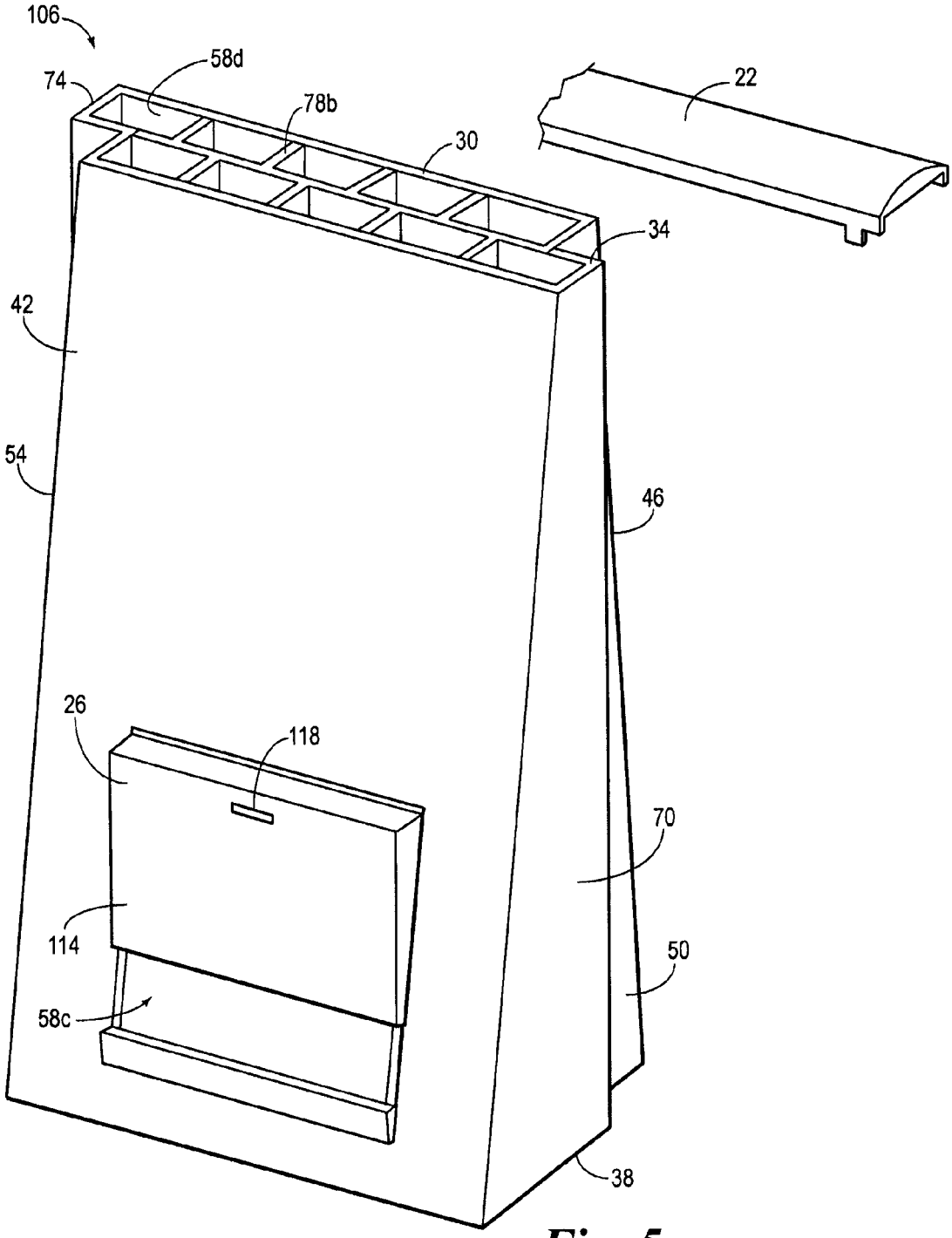
FIG. 5 is a perspective view of a third embodiment of a barrier constructed in accordance with the present invention.
Figure 6:
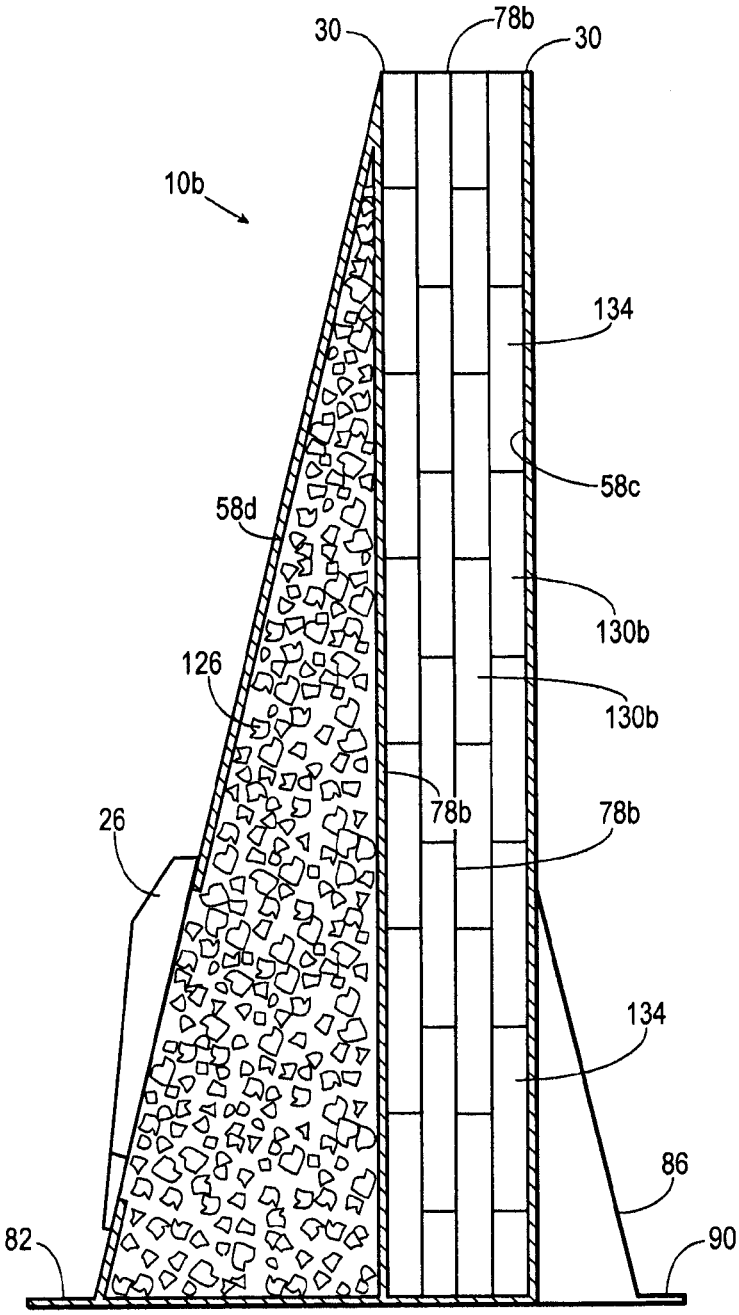
FIG. 6 is a cross-sectional side view of the barrier of FIG. 5.

Referring now to FIGS. 5 and 6, shown therein and designated by the reference numeral 10*b* is a third embodiment of a barrier constructed in accordance with the present invention. The barrier 10*b* is similar in form and construction to the barriers 10 and 10*a* of FIGS. 2-4, with one primary difference. The barrier 10*b* is provided with plurality of interior walls 78*b*, which may be formed separately or as a singular unit, that divide the cavity 58 into a plurality of substantially-vertically-oriented rear portions or cavities 58*c*. The interior walls 78*b* preferably further define a front portion or cavity 58*d*. The front cavity 58*c* is selectively filled with a deformation fill material 126 as is described above with reference to FIG. 4.

The rear cavities 58*b* are preferably sized and shaped to receive a specific energy-absorption fill material 130*b*. For example, in one embodiment the specific energy-absorption fill material 130*b* comprises a plurality of recycled phone books 134 stacked tightly together so as to substantially fill the rear cavities 58*c*. In the preferred embodiment of the barrier 10*b*, four layers of phone books 134 are provided. In other embodiments, any suitable number of layers of phone books 134 may be used, such as, for example, one, two, three, five, or the like. Most preferably, however, in applications where the barrier 10*b* may be expected to be hit with projectile such as bullets and the like, at least three or more layers of phone books 134 are provided. As shown, the phone books 134 are preferably staggered both horizontally and vertically so as to prevent full-depth seams between phone books 134 that could provide points of weakness or high susceptibility to penetration by projectiles and the like. The phone books 134 are preferably staggered by about one half of the horizontal dimension of each phone book 134, and are preferably vertically staggered by about one half of the vertical dimension of each phone book 134. In some embodiments, the phone books 134 may not be staggered at all or may only be staggered in one direction. Where possible, it is preferred that the phone books 134 be staggered at least horizontally.

Figure 7:
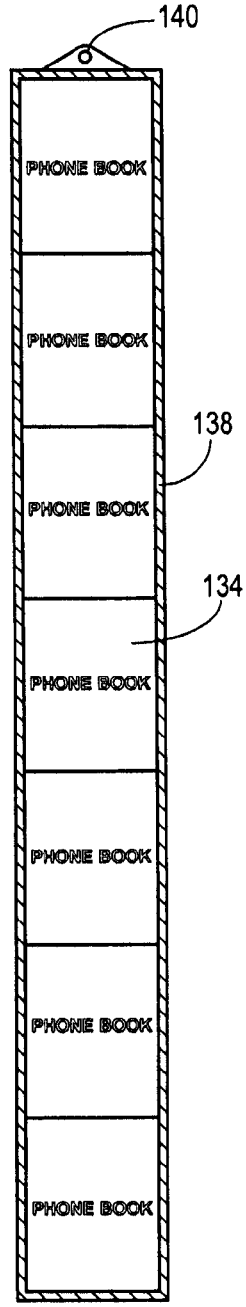
FIG. 7 is a front view of a sleeve of recycled phone books for use with the barrier of FIGS. 5 and 6.

As shown in FIG. 7, the recycled phone books 134 used for the specific energy-absorption fill material 132*b* are enclosed, encased, and/or sealed within a sleeve 138. In some embodiments, the phone books 134 are compressed prior to being enclosed in the sleeve 134. In yet further embodiments, the phone books 134 are dipped in wax or similar substantially-impermeable material so as to control moisture within the phone books 134. The sleeve 138 is preferably formed of an impermeable material such as plastic, vinyl, polymer, or the like so as to prevent moisture from entering or exiting the sleeve 138. In one embodiment, the sleeve 138 of phone books 134 is provided with and anchor point 140, such as a grommet, hook, or other suitable fastener to permit the sleeve 138 of phone books 134 to be affixed, attached, or hung from a point at or near the upper end 34 of the body portion 18 to prevent sagging. For example, in some embodiments, the energy-absorption capacity of the phone books 134 may be improved by soaking the phone books 134 with water or other fluid. Additionally, soaking or wetting the phone books may provide resistance to combustion. In such an embodiment, the sleeve 134 preferably prevent water from evaporating and thereby escaping from the sleeve 138. In other embodiments, the energy-absorption capacity of the phone books 134 may be higher when the phone books 134 are dry. In such an embodiment, the sleeve 138 preferably prevents moisture from entering the sleeve 138. In other embodiments, the sleeve 138 may simply hold the phone books 134 in a desired configuration, and the sleeve 138 may therefore be constructed of any suitable material, such as, for example, screen, mesh, netting, fabric, or the like.

In one embodiment of the barrier 10*b* of FIG. 6, the rear cavities 58*d* are preferably sized to receive a specified number of sleeves 138 of phone books 134 (FIG. 7). For example, as shown in FIG. 6, each rear cavity 58*d* of the barrier 10*b* is sized to receive two sleeves 138 of phone books 134 as the specific energy-absorption fill material 130*b*. In other embodiments, nearly any suitable material may be used for the specific energy-absorption fill material 130*b*, such as, for example, reams of paper, recycled newspapers, blocks of shredded recycled paper, recycled plastics, or the like. Such alternative materials may be used with or without a sleeve of the type described above with reference to FIG. 7.

Figure 8A:
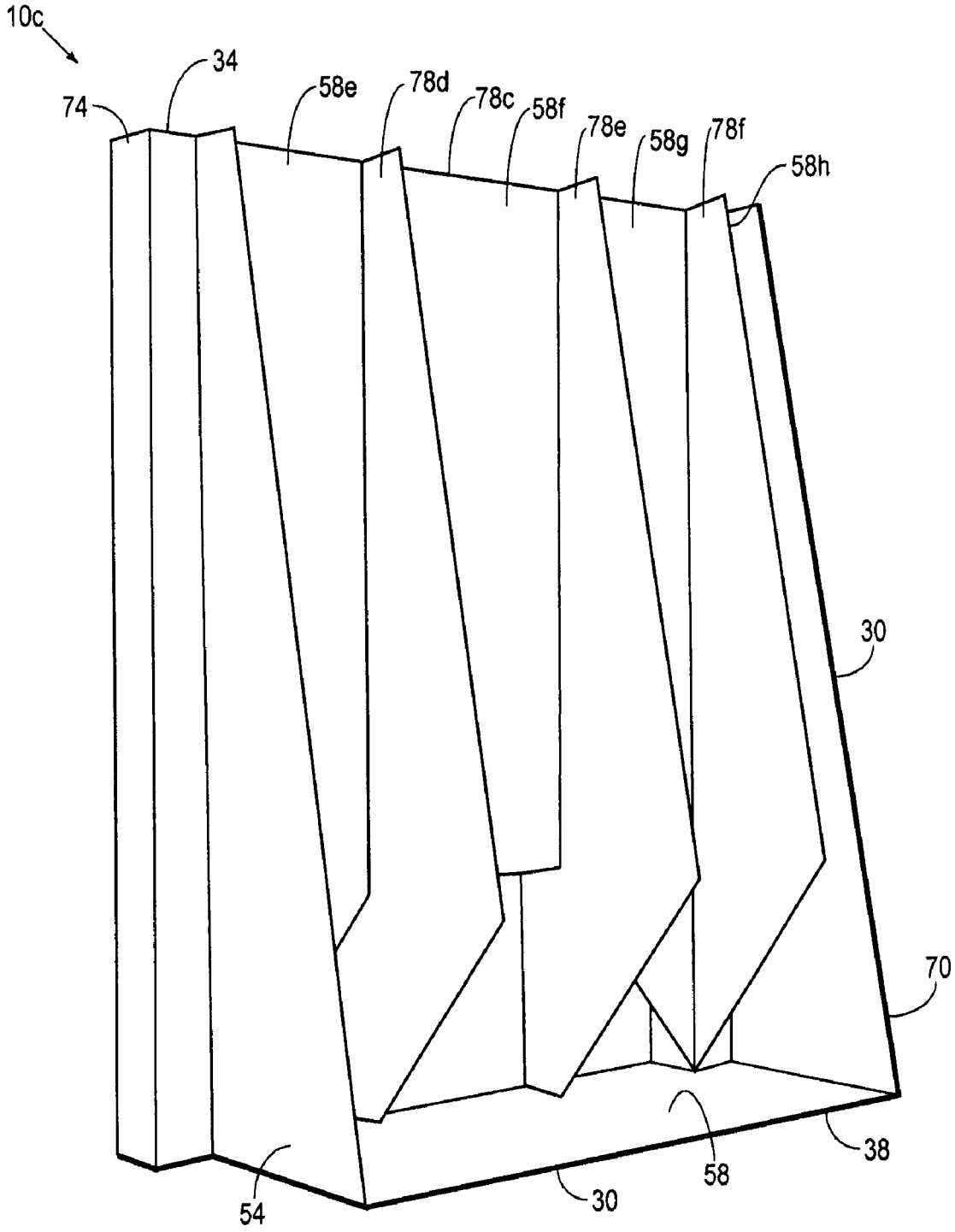
FIGS. 8A and 8B are enlarged, partially-cutaway perspective views of a fourth embodiment of a barrier constructed in accordance with the present invention.
Figure 8B:
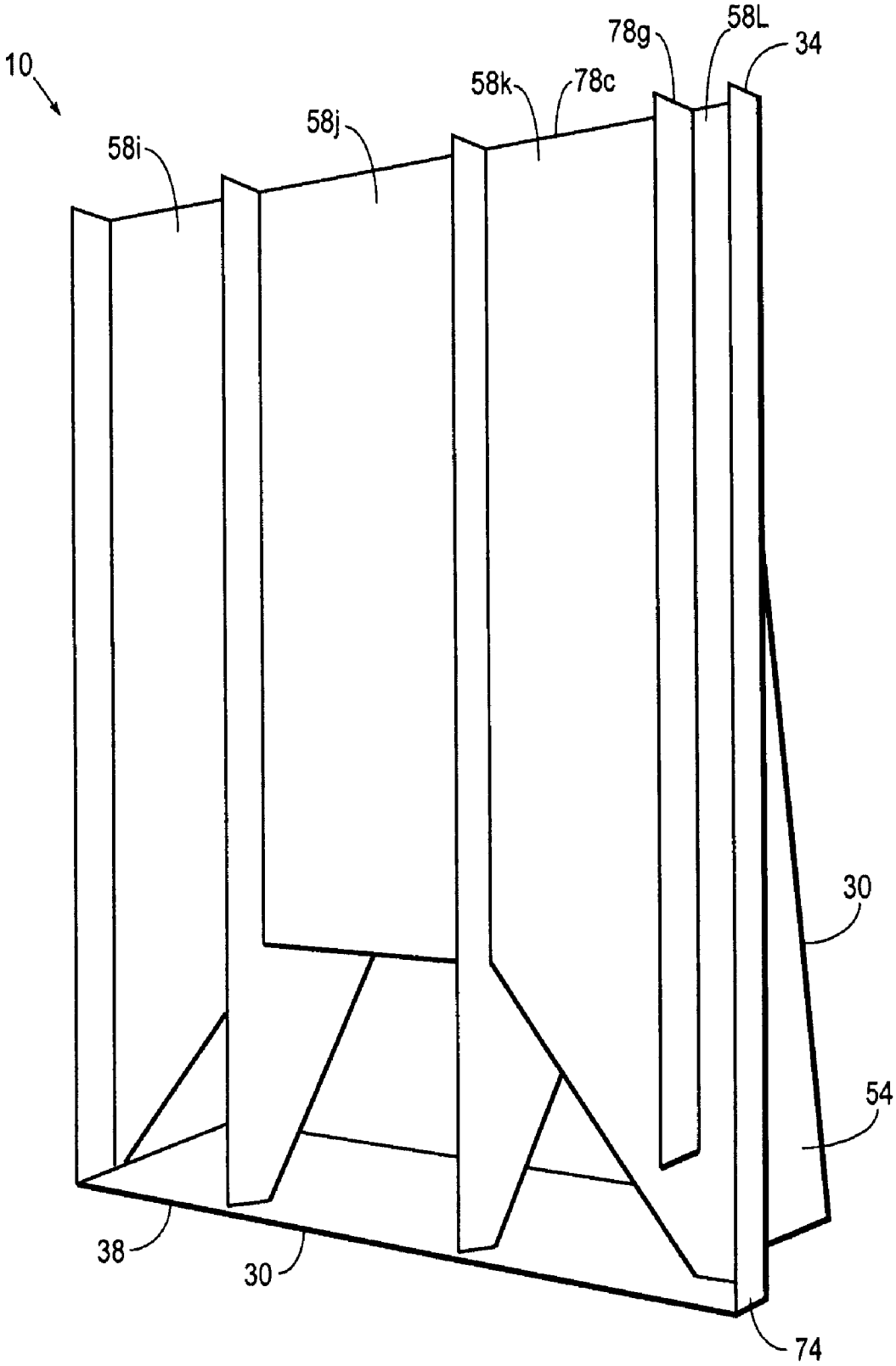

Referring now to FIGS. 8A and 8B, shown therein and designated by the reference numeral 10*c* are enlarged, partially-cutaway perspective views of a third embodiment of a barrier constructed in accordance with the present invention, depicting an exemplary configuration for interior walls 78. For clarity, the barrier 10*c* is shown with the portions of the sidewall 30 that define the front and rear sides 42 and 46 cut away to show the interior walls 78. As shown, the barrier 10*c* is provided with a plurality of interior walls 78 that divide the cavity 58 into a plurality of portions or compartments 58*e*, 58*f*, 58*g*, etc. in fluid communication with one another, near the lower end 38 of the barrier 10*c*. Specifically, the barrier 10*c* is provided with a transverse interior wall 78*c* spanning the entire width of the barrier 10*c* and a plurality of a medial interior walls 78*d*, 78*e*, 78*f*, and 78*g* substantially perpendicular to the transverse interior wall 78*c*. As also shown, a lower portion of each of the interior walls 78*c*, 78*d*, 78*e*, etc. is left open or omitted such that each of the portions 58*e*, 58*f*, etc. of the cavity 58 are in communication with on another. In this way, if a barrier 10*c* must be moved, the fill material (not shown) may be more easily removed via the side cover 26 (FIGS. 2 and 5).

Figure 9:
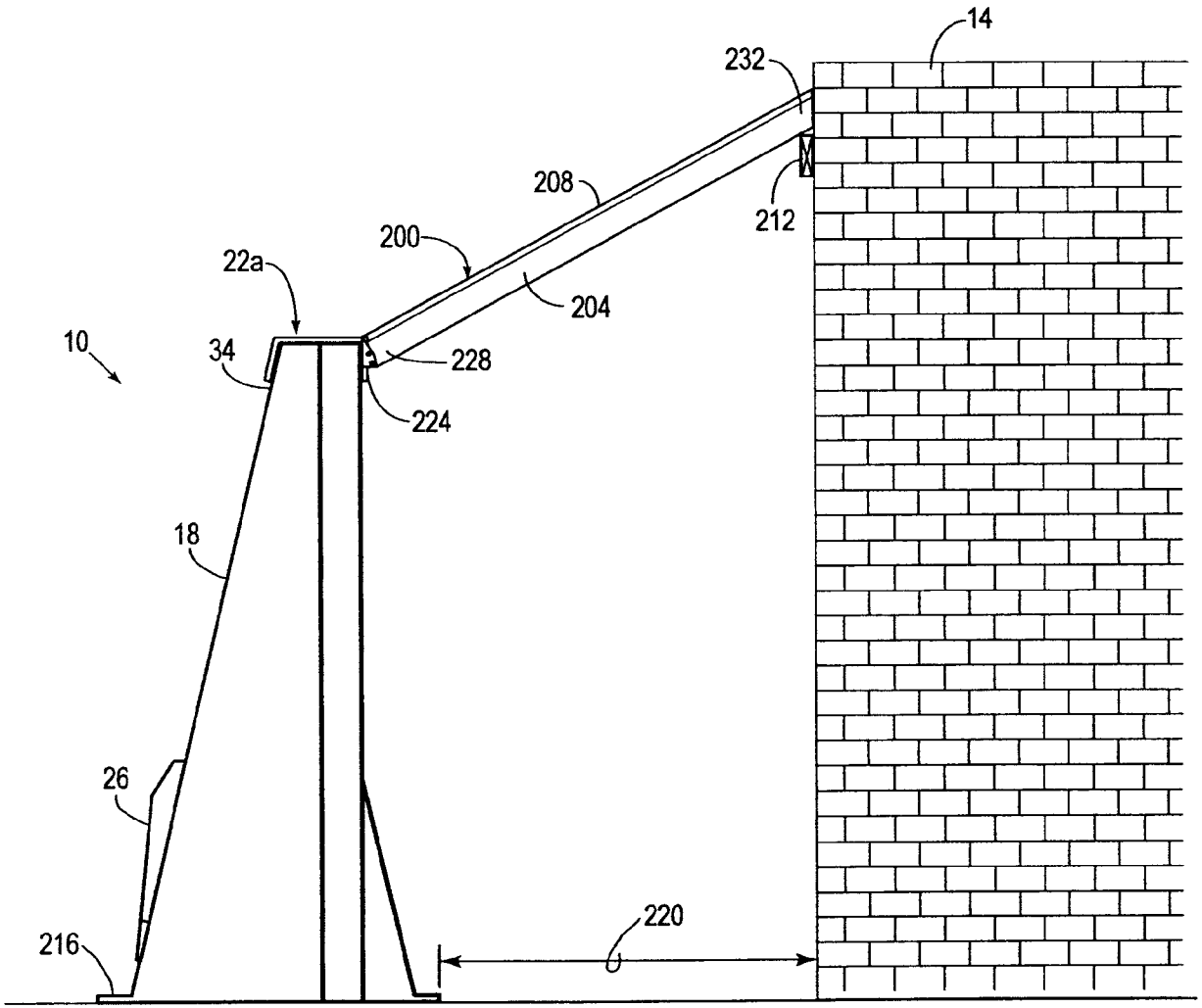
FIG. 9 is a side view of a roof assembly constructed in accordance with the present invention extending from the barrier to an exemplary structure.

Referring now to FIG. 9, shown therein and designated by the reference numeral 200 is one embodiment of a roof assembly constructed in conjunction with a barrier 10 in accordance with present invention. The roof assembly 200 includes a barrier 10 having a specially-designed upper cover 22*a*, one or more roof joists 204, a roof surface 208, and one or more roof supports 212 attached to or supported by and/or near a structure 14. The barrier 10 is supported on the ground 216 or other supporting surface a distance 220 away from a wall or other portion of the structure 14, as shown. The specially-designed upper cover 22*a* is fastened to the body portion 18 of the barrier 10 at or near the upper end 34 of the barrier portion 18 thereof, as described above with reference to FIGS. 2 and 3. The upper cover 22*a* is provided with one or more roof brackets 224 that engage and/or support a first end 228 of the one or more roof joists 204. The one or more roof supports 212 support a second end 232 of the one or more roof joists 204 such that the one or more roof joists 204 span the distance 220 between the barrier 10 and the structure 14.

The one or more roof supports 212 may be formed by simply bolting or otherwise affixing a length of dimensional lumber, such as a 2×4, 2×8, etc. to an exterior surface of the structure 14, or may include joist brackets such as are formed from stamped and/or cold-rolled steel and are available at lumber stores and the like. Additionally, the one or more roof supports 212 may include bolts (not shown) directly fastening or connecting the roof joists 204 to the structure 14. The roof joists 204 are preferably formed from dimensional lumber, such as 2×4's, 2×6's, etc. or the steel equivalent thereof, or may be formed of any suitable structural member, such as a length of pipe, I-beam, angle iron, or the like. The roof surface 208 may be formed from any suitable material, such as for example, plywood, paneling, corrugated metal or fiberglass, sheet steel, sheet fiberglass, rolled roofing material, shingles, or any combination of listed or other roofing materials. In other embodiments, the roof joists 204 and roof surface 208 may be combined into a single component, such as, for example, a plastic roof panel having integral transverse support components that may function in similar fashion as the roof joists 204. As many roofs are, the roof assembly 200 is preferably constructed such that the roof surface 208 is angled to cause rainwater and the like to will flow away from the structure 14.

Figure 10:
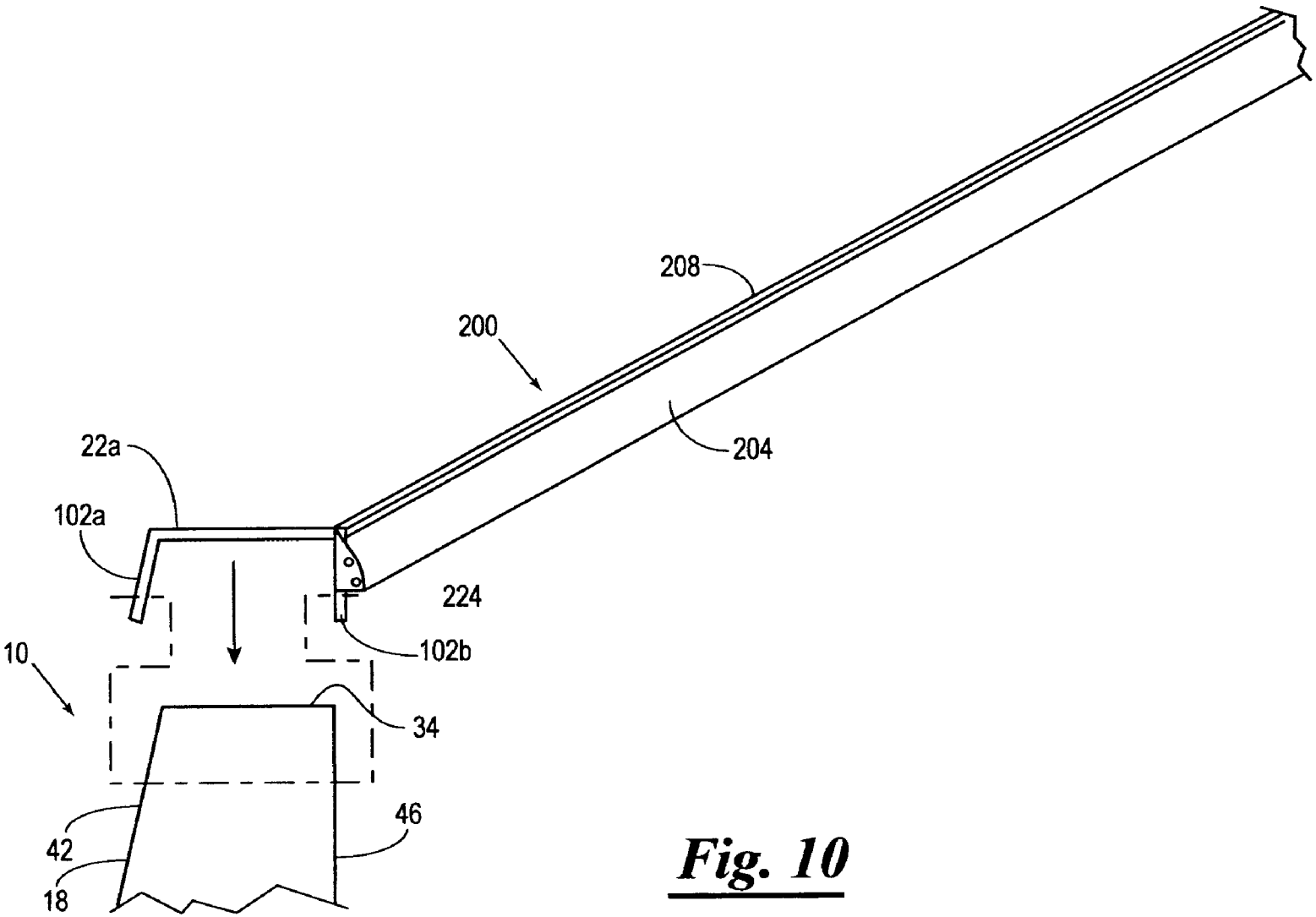
FIG. 10 is an enlarged, partially-exploded side view of a roof bracket for use in the roof assembly of FIG. 7 constructed in accordance with the present invention.

Referring now to FIG. 10, shown therein is an enlarged, partially-exploded view of a portion of the roof assembly 200. As shown, the specially designed upper cover 22*a* is similar in shape to the upper cover 22 described above with reference to FIG. 2, with several important differences. The upper cover 22*a* is preferably provided with a cover portion 98*a*, a front longitudinal support 102*a*, and a rear longitudinal support 102*b*. As shown, the front and rear longitudinal supports 102*a* and 102*b* are preferably elongated and shaped to firmly seat on the upper end 34 of the body member 18, as shown. More specifically, the front longitudinal support is angled to coincide with and engage the front side 42 of the body portion 18, and the rear longitudinal support 102*b* is angled to coincide with and engage the rear side 46 of the body portion 18.

The one or more roof brackets 224 are preferably attached to, or formed integrally with, the rear longitudinal support 102*b* of the upper cover member 22*a*. The roof brackets 224 are preferably each formed similarly to a joist hanger bracket (not separately shown) of one of the various types known in the art. Specifically, the roof brackets 224 are preferably each formed in such a configuration as to permit a roof joist 224 to be fastened or connected thereto by any suitable means, for example, nails, screws, rivets, adhesives, clamps, welds, or the like.

While various presently-preferred embodiments of the present invention are described herein, changes may be made in the embodiments of the invention described herein, or in the parts or the elements of the embodiments described herein, or in the steps or sequence of steps of the methods described herein, without departing from the spirit and/or the scope of the invention as defined in the following claims.

What is claimed is:

1. A barrier comprising:

a freestanding body member having a first side, a second side, a front side, a rear side, an upper end, a lower end, and at least one cavity within the body member, the body member having a first opening in the upper end extending along substantially the entire length and width of the upper end and a second opening in at least one of the front side and the rear side adjacent to the lower end, the first opening and the second opening being in fluid communication with the cavity, and the first opening being in fluid communication with the second opening via the cavity, the body member having a first overlap portion and a second overlap portion, the first overlap portion extending from the first side adjacent to the front side and spaced apart from the rear side and the first overlap portion extends from the lower end to the upper end, the second overlap portion extending from the second side adjacent to the rear side and spaced apart from the front side and the second overlap portion extends from the lower end to the upper end, the second overlap portion shaped to mate in an overlapping manner with the first overlap portion of an adjacent freestanding body member;

a first cover removably positioned over the first opening; and a second cover removably positioned over the second opening.

2. The barrier of claim 1, wherein the one or more cavities are filled with a fill material selected from the group consisting of: sand, soil, clay, gravel, aggregate, cement, paper, polymer, alloy, paper, recycled paper, books, recycled newspaper, recycled plastics, and any combination thereof.

3. The barrier of claim 1, further comprising:

one or more interior walls dividing the one or more cavities into one or more front cavities and one or more rear cavities, the one or more front cavities adjacent to the front surface of the barrier and spaced apart from the rear surface of the barrier, and the one or more rear cavities adjacent to the rear surface of the barrier.

4. The barrier of claim 3, wherein the one or more interior walls are contiguous with the body member.

5. The barrier of claim 3, wherein the one or more front cavities are filled with a deformation fill material and the one or more rear cavities are filled with an energy absorption fill material.

6. The barrier of claim 5, wherein the deformation fill material is selected from the group consisting of: aggregate, gravel, cement, alloy, and any combination thereof.

7. The barrier of claim 5, wherein the energy-absorption fill material is selected from the group consisting of: sand, soil, clay, cement, paper, polymer, alloy, paper, recycled paper, books, recycled newspaper, recycled plastics, and any combination thereof.

8. The barrier of claim 7, wherein the books are stacked and substantially contained in one or more sleeves.

9. The barrier of claim 8, wherein the books are coated in wax.

10. A barrier wall, comprising:

two or more barriers, each barrier comprising:

a freestanding body member having a first side, a second side, a front side, a rear side, a depth between the front and rear sides, and at least one cavity within the body member, the body member having a first opening in the upper end extending along substantially the entire length and width of the upper end and a second opening in at least one of the front side and the rear side adjacent to the lower end, the first opening and the second opening being in fluid communication with the cavity, and the first opening being in fluid communication with the second opening via the cavity, the body member having a first overlap portion and a second overlap portion, the first overlap portion extending from the first side adjacent to the front side and spaced apart from the rear side and the first overlap portion extends from the lower end to the upper end, the second overlap portion extending from the second side adjacent to the rear side and spaced apart from the front side and the second overlap portion extends from the lower end to the upper end;

a first cover removably positioned over the first opening; and a second cover removably positioned over the second opening;

wherein a first one of the barriers is disposed laterally adjacent to a second one of the barriers, the first overlap portion of the first barrier overlapping the second overlap portion of the second barrier such that the overlapping first and second overlap portions have a combined depth at least as great as the depth of at least one of the laterally-adjacent barriers.

11. The barrier wall of claim 10, wherein the one or more cavities are filled with a fill material selected from the group consisting of: sand, soil, clay, gravel, aggregate, cement, paper, polymer, alloy, paper, recycled paper, books, recycled newspaper, recycled plastics, and any combination thereof.

12. The barrier wall of claim 10, wherein at least one of the barriers further comprises one or more interior walls dividing the one or more cavities into one or more front cavities and one or more rear cavities, the one or more front cavities adjacent to the front side of the barrier and spaced apart from the rear side of the barrier, and the one or more rear cavities adjacent to the rear side of the barrier.

13. The barrier wall of claim 12, wherein the one or more front cavities are filled with a deformation fill material and the one or more rear cavities are filled with an energy absorption fill material.

14. The barrier wall of claim 13, wherein the deformation fill material is selected from the group consisting of: aggregate, gravel, cement, alloy, and any combination thereof.

15. The barrier wall of claim 13, wherein the energy-absorption fill material is selected from the group consisting of: sand, soil, clay, cement, paper, polymer, alloy, paper, recycled paper, books, recycled newspaper, recycled plastics, and any combination thereof.

16. The barrier of claim 15, wherein the books are stacked and contained in one or more sleeves.

17. The barrier wall of claim 16, wherein the books are coated in wax.

18. A method of constructing a barrier wall comprising the steps of:

providing two or more barriers, each of the barriers comprising:

a freestanding body member having a first side, a second side, an upper end, a lower end, a front side, a rear side, an upper end, a lower end, and at least one cavity within the body member, the body member having a first opening in the upper end extending along substantially the entire length and width of the upper end and a second opening in at least one of the front side and the rear side adjacent to the lower end, the first opening and the second opening being in fluid communication with the cavity, and the first opening being in fluid communication with the second opening via the cavity, the body member having a first overlap portion and a second overlap portion, the first overlap portion extending from the first side adjacent to the front side and spaced apart from the rear side and the first overlap portion extends from the lower end to the upper end, the second overlap portion extending from the second side adjacent to the rear side and spaced apart from the front side and the second overlap portion extends from the lower end to the upper end;

a first cover removably positioned over the first opening; and a second cover removably positioned over the second opening;

disposing a first one of the barriers is laterally adjacent to a second one of the barriers such the first overlap portion of the first barrier overlaps the second overlap portion of the second barrier such that the overlapping first and second overlap portions have providing a combined depth at least as great as the depth of at least one of the laterally-adjacent barriers.

19. The method of claim 18, further comprising the step of:

filling the one or more cavities with a fill material selected from the group consisting of: sand, soil, clay, gravel, aggregate, cement, paper, polymer, alloy, paper, recycled paper, books, recycled newspaper, recycled plastics, and any combination thereof.

20. The method of claim 18, wherein at least one of the barriers further comprises one or more interior walls dividing the one or more cavities into one or more front cavities and one or more rear cavities, the one or more front cavities adjacent to the front side of the barrier and spaced apart from the rear side of the barrier, and the one or more rear cavities adjacent to the rear side of the barrier.

21. The method of claim 20, further comprising the steps of:

filling the one or more front cavities with a deformation fill material; and filling the one or more rear cavities with an energy absorption fill material.

22. The method of claim 21, wherein the deformation fill material is selected from the group consisting of: aggregate, gravel, cement, alloy, and any combination thereof.

23. The method of claim 21, wherein the energy-absorption fill material is selected from the group consisting of: sand, soil, clay, cement, paper, polymer, alloy, paper, recycled paper, books, recycled newspaper, recycled plastics, and any combination thereof.

24. The method of claim 23, wherein the books are stacked and contained in one or more sleeves.

25. The method of claim 24, wherein the books are coated in wax.

* * * * *